United States Patent [19]

Reinertz et al.

[11] Patent Number: 4,941,599

[45] Date of Patent: Jul. 17, 1990

[54] METHOD AND APPARATUS FOR THOROUGHLY MIXING A SUSPENSION CONTAINING A FLUID AND SOLID MATTER CONSTITUENTS

[75] Inventors: Ulrich Reinertz, Wuppertal; Wolfgang Tröger, Pulheim; Jürgen Wockel, Wuppertal, all of Fed. Rep. of Germany

[73] Assignee: Vorwerk & Co. Interholding GmbH, Wuppertal, Fed. Rep. of Germany

[21] Appl. No.: 284,998

[22] Filed: Dec. 15, 1988

[30] Foreign Application Priority Data

Dec. 15, 1987 [DE] Fed. Rep. of Germany ..... 3742466

[51] Int. Cl.[5] ..... B65D 83/00

[52] U.S. Cl. ..... 222/401; 222/630

[58] Field of Search ..... 222/630, 631, 634, 635, 222/401, 402; 366/101, 106

[56] References Cited

U.S. PATENT DOCUMENTS

| | | | |
|---|---|---|---|
| 945,505 | 1/1910 | Fess | 222/401 |
| 961,456 | 6/1910 | Mastin | 222/402 |
| 1,246,213 | 11/1917 | Zawels et al. | 222/401 |
| 1,406,904 | 2/1922 | Rose | 222/631 |
| 4,165,025 | 8/1979 | Mascia et al. | 222/401 |
| 4,341,330 | 7/1982 | Mascia et al. | 222/401 |

FOREIGN PATENT DOCUMENTS

| | | | |
|---|---|---|---|
| 630569 | 10/1949 | United Kingdom | 222/631 |

*Primary Examiner*—H. Grant Skaggs

*Attorney, Agent, or Firm*—Walter Ottesen

[57] ABSTRACT

The invention is directed to an apparatus and a method for thoroughly mixing a suspension containing a fluid and solid matter constituents and spraying the thoroughly mixed suspension onto a surface. The apparatus includes a pressure and seal tight container enclosed on all sides for accommodating the suspension therein. The container has a top region and has a base region whereat the solid matter constituents tend to collect to form a sediment. A cylinder and a piston generate a charge of air under pressure which is conducted through a passage into the base region of the container to break up the sediment and thoroughly mix the solid matter constituents in the fluid as the air under pressure rises through the suspension to collect at the top region of the container where it imparts pressure to the suspension. A nozzle unit mounted on the container vents the container to permit the air under pressure to entrain the thoroughly mixed suspension to form a spray. With the invention, the suspension is always thoroughly mixed for each pumping operation and during the spraying operation so that a loss of function because of blockage of the spray system is prevented.

19 Claims, 3 Drawing Sheets

METHOD AND APPARATUS FOR THOROUGHLY MIXING A SUSPENSION CONTAINING A FLUID AND SOLID MATTER CONSTITUENTS

FIELD OF THE INVENTION

The invention relates to a method and apparatus for thoroughly mixing a suspension containing a fluid and solid matter constituents. The suspension is introduced into a completely enclosed container which is pressure-tight and pressure-sealed and is sprayed onto an ambient surface via a nozzle by means of a pressure spray system. The pressure spray system is charged with pressure from outside of the container.

BACKGROUND OF THE INVENTION

An apparatus of the kind described above has the purpose to prevent settling of the solid matter constituents out of the suspension mixture onto the base region of the container or to homogeneously integrate the settled constituents into the suspension and make the same available to the spray system without the latter becoming blocked.

Accordingly, it is known to mix the individual components of a suspension by means of an intensive shaking of the container or to introduce a plurality of balls into the container which again make the settled solid matter constituents accessible by swirling the suspension.

With respect to the foregoing, it is disadvantageous in that clumps remain in the suspension because of an inadequate shaking of the container which brings about a blockage of the entire valve system. This blockage of the valve system by the clumps of solid matter constituents which have penetrated into the valve system can no longer be sprayed free subsequently. This condition occurs because the solid matter constituents become impacted in the riser tube and thereby block the entire system. A further disadvantage of the known systems is that there is no large surface available at the base of the container in order that the fastest possible distribution of the solid matter constituents is obtained by shaking.

SUMMARY OF THE INVENTION

It is an object of the invention to provide an apparatus wherein the above-mentioned disadvantages are prevented. It is a further object of the invention to provide an apparatus wherein the spray system can be used repeatedly together with a reliable mixing of the settled solid matter constituents with the suspension liquid. It is a further object of the invention to provide such an apparatus which ensures a reliable delivery of the suspension mixture from the spray container without further manipulation. It is a still further object of the invention to provide a method for thoroughly mixing a suspension containing a fluid and solid matter constituents and for spraying the same onto a surface without the nozzle and valve system becoming blocked because of clumping of the solid matter constituents.

The apparatus of the invention is for thoroughly mixing a suspension containing a fluid and solid matter constituents and for spraying the thoroughly mixed suspension onto a surface. The apparatus includes: a pressure and seal tight container enclosed on all sides for accommodating the suspension therein, the container having a base region whereat the solid matter constituents tend to collect to form a sediment and the container also having a top region; pressure charging means mounted on the container for pumping air into the container, the pressure charging means including a cylinder and a piston for generating a charge of air under pressure; passage means for conducting the charge into the base region to break up the sediment and thoroughly mix the solid matter constituents in the fluid as the air under pressure rises through the suspension to collect at the top region to impart pressure to the thoroughly mixed suspension; and, nozzle means mounted on the container for venting the container to permit the air of the charge to entrain the thoroughly mixed suspension to form a spray.

This solution affords the advantage that the suspension is thoroughly mixed continuously for each pumping operation and during the spraying operation so that a loss of function because of blockage of the spray system is prevented. A further advantage of the invention is that the spray system is utilized in refillable spray containers which are not equipped with propellant gas. A still further advantage is that spray systems of the kind referred to above and available in the marketplace can be retrofitted by means of a separate usable part.

BRIEF DESCRIPTION OF THE DRAWINGS

The invention will now be described with reference to the drawings wherein.

DESCRIPTION OF THE PREFERRED EMBODIMENTS OF THE INVENTION

The apparatus according to the invention includes a container incorporating a cylinder 2 having a base **2*a* and defining a tubular pump chamber 2*b*. The container 10 further includes a sleeve 4 disposed in surrounding spaced relationship to the cylinder 2. The sleeve 4 and the cylinder 2 conjointly define an annular passage 11**.

Figure 1:
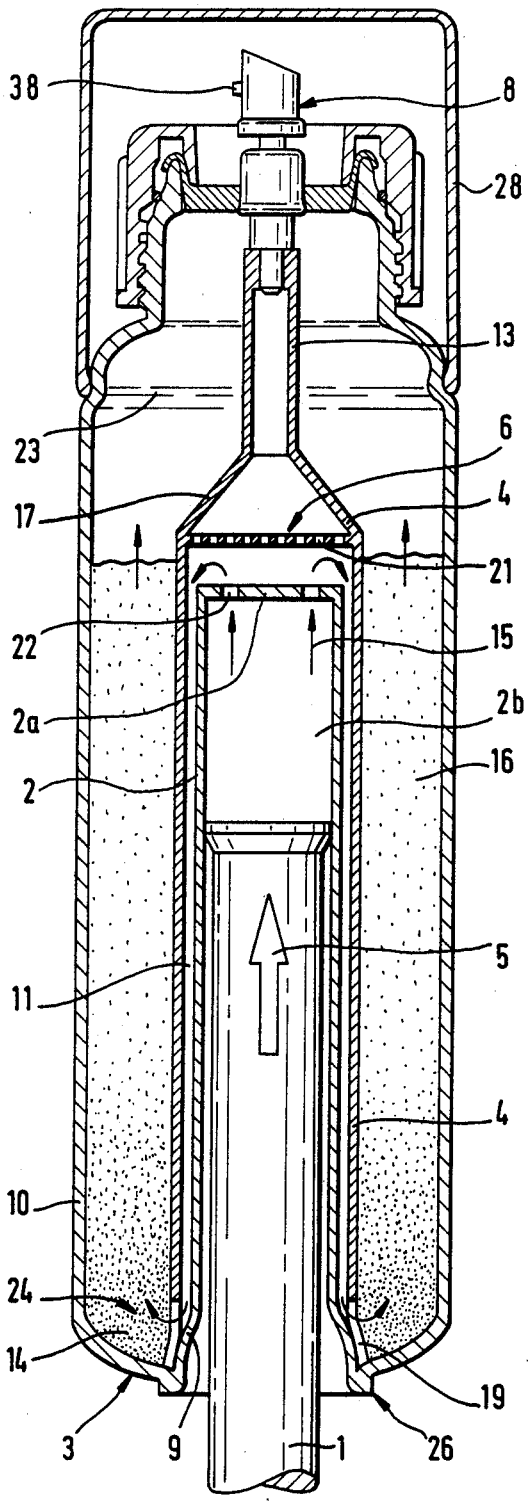
FIG. 1 is a side elevation view, in section, of an apparatus according to an embodiment of the invention wherein the pressure medium is introduced into the container of the housing with the aid of an air pump.

In FIG. 1, the pump piston 1 is manually actuated to cause air 15 to flow through bores 22 formed in base **2*a*. This charge of air under pressure then passes through passage 11 and from there is introduced into the container 10 which is both seal tight and pressure tight. The charge of air is introduced under pressure into the container 10 through slit-like openings 19. The air under pressure flows outwardly in all directions in the hollow annular chamber 11 and is prevented from flowing further by valve unit 8. In the lower base region 3, the sleeve 4 is connected in a force tight manner to an inwardly flared portion 9 of the container housing 10. The sleeve 4 includes the slit-like openings 19 through which the air under pressure enters the container 10**.

The air flows through the slits 19 and swirls the sediment 24 of the solid matter constituents 14 of the suspension mixture 16 as the air rises into the upper portion 23 of the container. With this action, the solid matter constituents 14 are distributed uniformly over the entire volume of the suspension as long as the pumping operation is maintained. This swirling action is repeated for each repumping.

When the appropriate pressure is built up in the container 10, then the pump piston is latched at the base region 26 of the container and the suspension mixture 16 is vented to the ambient via the nozzle and valve unit 8.

Figure 2:
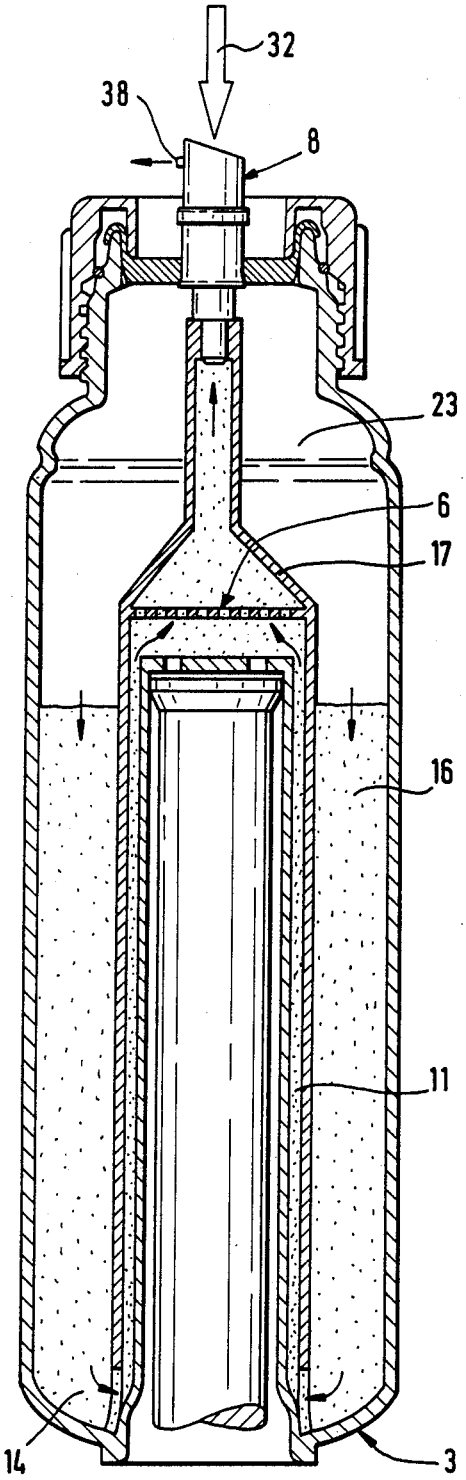
FIG. 2 is a side elevation view, in section, of the apparatus of FIG. 1 with the cover removed and showing the flow of the mixed suspension into and out of the nozzle; and, FIG. 3 is a side elevation view of the nozzle and valve unit for forming the spray.

The operation of the apparatus of the invention is shown in FIG. 2 wherein the cover 28 shown in FIG. 1 has been removed.

In FIG. 2, the container 10 is vented by an operator by manually pressing downwardly on head 30 of the nozzle and valve unit 8 as indicated by arrow 32.

Figure 3:
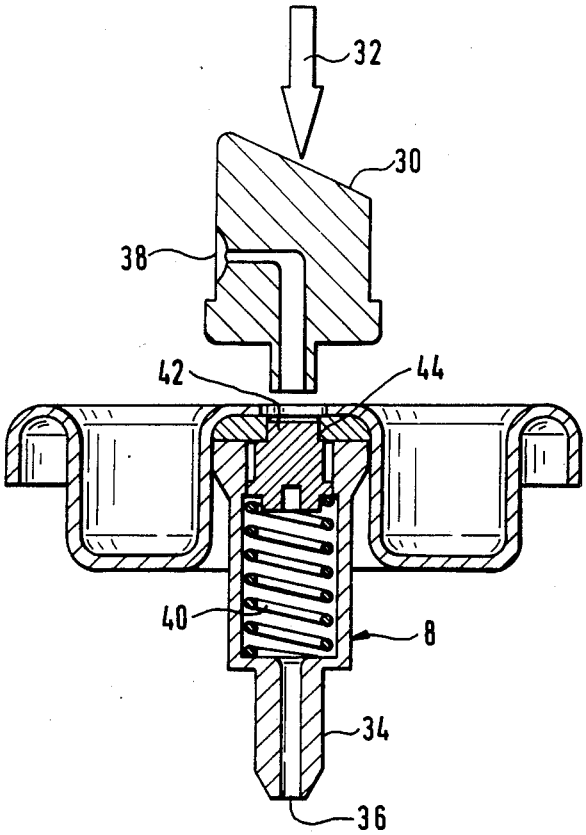

The nozzle and valve unit 8 is shown in FIG. 3 and includes a holder 34 defining a spray throat 36 for conducting the suspension under pressure to nozzle 38. A spring 40 resiliently biases valve body 42 against valve seat 44. The head 30 of the nozzle and valve unit 8 is seated in the latter and releases the suspension under pressure when pressed downwardly in the direction of arrow 32.

The thoroughly mixed suspension flows under the propellant pressure of the air in the upper region 23 of the container. When the valve body 42 of the nozzle and valve unit is displaced from its valve seat 44, the air in region 23 causes the suspension 16 to flow through the slits 19 into the hollow annular chamber 11 disposed between the sleeve 4 and the cylinder 2 where it moves upwardly to and through sieve insert 6. After passing through the sieve insert 6, the suspension mixture passes into the tapered outlet region 17 so that an absolutely uniform distribution of the solid matter constituents 14 is present ahead of the spray throat 36 of the nozzle and valve unit 8. By pressing the head 30 downwardly and opening the valve, the air 15 is vented to the ambient and entrains the suspension mixture 16. A uniform venting and spraying of the suspension mixture onto a surface external to the apparatus is thereby provided.

The sieve insert 6 can have a plurality of openings each having a diameter of $1\pm0.3$ mm. On the other hand, each of the slit-like openings 19 can have a length of $10\pm1$ mm and a width of $2\pm0.5$ mm.

The sleeve 4 can be radially spaced from cylinder 2 by an amount in the range of 0.2 to 10 mm. The outlet region 13 of the sleeve 4 can have an outer diameter lying in the range from 7.9 mm to 8.2 mm with a wall thickness of 1 mm. The inner diameter of the outlet region 13 can be in the range of 5.9 to 6.2 mm independently of the wall thickness of the sleeve 4.

It is understood that the foregoing description is that of the preferred embodiments of the invention and that various changes and modifications may be made thereto without departing from the spirit and scope of the invention as defined in the appended claims.

What is claimed is:

1. A spray device for spraying a thoroughly mixed suspension of liquid and solid matter constituents onto a surface, the spray device comprising:

a pressure and seal tight container enclosed on all sides to define a chamber for accommodating the suspension therein, said container having a lower portion terminating in a base wall defining a base region of said chamber whereat said solid matter constituents tend to collect to form a sediment and said container also having an upper portion defining a top region of said chamber;

aperture means formed in said base wall for leading directly into said base region;

pressure charging means mounted on said container for pumping air into said chamber, said pressure charging means including a cylinder and a piston for generating a charge of air under pressure in said cylinder;

passage means connecting said cylinder to said aperture means for conducting said charge of air in a first direction from said cylinder to said aperture means so as to permit said charge to enter into said base region to break up said sediment and thoroughly mix said solid matter constituents in said liquid as the air under pressure rises in said chamber and through said suspension to collect in said top region of said chamber to impart pressure to said suspension;

said aperture means being formed only in said base wall so as to permit the full flow of sid charge of air to act on said sediment in said base region;

a nozzle unit mounted on said container and including nozzle channel means leading from said passage means to the ambient; and, valve means for opening said nozzle channel means to the ambient to thereby vent said chamber and permit the air of said charge to entrain the thoroughly mixed suspension and flow out of said chamber through said aperture means and along said passage means in a second direction opposite said first direction and into said nozzle channel means to enter the ambient as a spray.

2. The spray device of claim 1, said container having a top wall defining said upper portion and an outer wall defining a longitudinal axis and extending upwardly from said base wall to said top wall; said nozzle unit being mounted in said top wall; said container also having an inner wall disposed in surrounding spaced relationship to said axis and extending upwardly from said base wall to said nozzle unit; said outer and inner walls conjointly defining said chamber as an annular enclosure for accommodating the suspension therein; said cylinder having a lower end connected to said base wall and extending upwardly along said axis within and in spaced relationship to said inner wall so as to cause said cylinder and said inner wall to conjointly define a first portion of said passage means; said cylinder having an end wall facing toward said nozzle unit and said inner wall extending up beyond said end wall to said nozzle unit to define the remaining portion of said passage means; said cylinder and said piston conjointly defining a pump chamber; said cylinder having an opening formed therein for allowing said charge of air under pressure to enter said passage means and flow therealong in said first direction and through said aperture means into said base region; and, said nozzle unit being mounted on said container so as to cause said nozzle channel means to lead to the ambient from said remaining portion of said passage means.

3. The spray device of claim 2, said inner wall and said cylinder conjointly defining said first portion of said passage means as an annular cylindrical hollow passage.

4. The spray device of claim 3, wherein the radial distance between said cylinder and said inner wall is in the range of 0.2 mm to 10 mm.

5. The spray device of claim 2, said inner wall including an outlet portion extending upwardly beyond said passage to define said remaining portion.

6. The spray device of claim 5, said outlet portion being a tubular extension of said inner wall and having an outer diameter in the range of 7.9 to 8.2 mm and a wall thickness of 1 mm.

7. The spray device of claim 5, said outlet portion being a tubular extension of said inner wall and having an inner diameter in the range of 5.9 to 6.2 mm.

8. The spray device of claim 2, further comprising mixing means formed in said passage means for providing a uniform distribution of the solid matter constituents in said flow ahead of said nozzle channel means.

9. The spray device of claim 8, said inner wall being tapered in spaced relationship to said end wall of said cylinder to define said mixing means in said passage means between said first portion and remaining portion thereof.

10. The spray device of claim 9, further comprising a sieve insert mounted in said passage means at said mixing means.

11. The spray device of claim 10, said sieve insert having a hole diameter of $1\pm0.3$ mm.

12. The spray device of claim 10, said cylinder and said outer wall conjointly defining an annular body with a seat formed therein at said lower portion of said container; a sleeve-like member placed over said cylinder in spaced relationship thereto so as to cause said cylinder and said sleeve-like member to define said first portion of said passage means; and, said sleeve-like member having a lower end fitted into said seat so as to form a tight connection with said annular body at said seat.

13. The spray device of claim 12, said aperture means being a plurality of slits formed in said inner wall at the lower end thereof.

14. The spray device of claim 13, each of said slits having a length of $10\pm1$ mm and a width of $2\pm0.5$ mm.

15. The spray device of claim 1, further comprising mixing means formed in said passage means for providing a uniform distribution of the solid matter constituents in said flow ahead of said nozzle channel means.

16. The spray device of claim 15, further comprising sieve insert mounted in said passage means at said mixing means.

17. A method for thoroughly mixing a suspension containing a liquid and solid matter constituents in a spray device which includes a container closed on all sides to define a chamber for accommodating the suspension therein, the container having a lower portion terminating in a base wall defining a base region of said chamber whereat said solid mater constituents tend to collect to form a sediment and the container also having an upper portion defining a top region of the chamber, the method comprising the steps of:

actuating a cylinder and piston to generate a charge of air under pressure;

directing said charge of air only into said base region via a passage in said spray device so that the air enters said base region only through an aperture in said base wall to break up said sediment and thoroughly mix said solid mater constituents in said fluid as the air under pressure rises through said suspension to collect at said top region to impart pressure to said suspension; and, actuating a nozzle and valve unit to vent said chamber to the ambient and permit the air of said charge to entrain the thoroughly mixed suspension and flow out of said chamber through said aperture along said passage in a direction opposite said first direction.

18. The method of claim 17, said container having a top wall defining said top region and an outer wall extending upwardly from said base wall to said top wall; said nozzle and valve unit being mounted in said top wall and an inner wall extending upwardly from said base wall to said nozzle and valve unit; said outer and inner walls conjointly defining an annular enclosure for accommodating the suspension therein; said device further including a cylinder and a piston for generating said charge of air under pressure; and, said cylinder having a lower end connected to said base wall and extending upwardly within and in spaced relationship to said inner wall so as to cause said cylinder and said inner wall to conjointly define said passage so as to extend up to said nozzle and valve unit.

19. The method of claim 18, wherien the apparatus further includes a sieve insert mounted in said passage for causing said suspension to be directed to said nozzle and valve unit in a uniform manner so as to ensure that a uniformly distributed mixture flows from said nozzle and valve unit.

* * * * *

UNITED STATES PATENT AND TRADEMARK OFFICE

CERTIFICATE OF CORRECTION

PATENT NO. : 4,941,599

DATED : July 17, 1990

INVENTOR(S) : Ulrich Reinertz, Wolfgang Tröger and Jürgen Wockel

It is certified that error appears in the above-identified patent and that said Letters Patent is hereby corrected as shown below:

In column 4, line 14: delete "sid" and substitute -- said -- therefor.

In column 5, line 36: insert -- a -- after "comprising".

In column 6, line 37: delete "wherien" and substitute -- wherein -- therefor.

Signed and Sealed this

First Day of October, 1991

*Attest:*

HARRY F. MANBECK, JR.

*Attesting Officer*

*Commissioner of Patents and Trademarks*